US010258829B2

(12) United States Patent
Merritt

(10) Patent No.: US 10,258,829 B2
(45) Date of Patent: Apr. 16, 2019

(54) ON-ROPE WORK POSITIONING DEVICE

(71) Applicant: Merritt Arboreal Design, Inc., Santa Cruz, CA (US)

(72) Inventor: Jaime A. Merritt, Santa Cruz, CA (US)

(73) Assignee: Merritt Arboreal Design, Inc., Santa Cruz, CA (US)

( * ) Notice: Subject to any disclaimer, the term of this patent is extended or adjusted under 35 U.S.C. 154(b) by 22 days.

(21) Appl. No.: 15/470,640

(22) Filed: Mar. 27, 2017

(65) Prior Publication Data

US 2017/0197116 A1 Jul. 13, 2017

Related U.S. Application Data

(63) Continuation of application No. 14/805,366, filed on Jul. 21, 2015, now Pat. No. 9,604,079.

(51) Int. Cl.

| | |
|---|---|
| ***A62B 1/14*** | (2006.01) |
| ***A63B 29/02*** | (2006.01) |
| ***A62B 35/00*** | (2006.01) |
| ***A62B 1/06*** | (2006.01) |
| ***A63B 29/08*** | (2006.01) |

(52) U.S. Cl.

CPC ..... *A63B 29/024* (2013.01); *A62B 1/06* (2013.01); *A62B 1/14* (2013.01); *A62B 35/0081* (2013.01); *A63B 29/08* (2013.01)

(58) Field of Classification Search

CPC . A63B 29/024; A62B 35/0037; A62B 35/005; A62B 35/0081; A62B 35/04; A62B 35/14

See application file for complete search history.

(56) References Cited

U.S. PATENT DOCUMENTS

| | | | |
|---|---|---|---|
| 2,285,603 | A | 9/1885 | Fell |
| 723,868 | A | 3/1903 | Herbert |
| 1,159,616 | A | 11/1915 | Swisher |
| 4,034,828 | A | 7/1977 | Rose |
| 4,226,305 | A | 10/1980 | Frestad |
| 4,311,218 | A | 1/1982 | Steffen |
| 4,413,382 | A | 11/1983 | Siegmann |

(Continued)

FOREIGN PATENT DOCUMENTS

EP 220070 A1 4/1987

OTHER PUBLICATIONS

International Search Report for International Application No. PCT/US2016/041758 dated Sep. 13, 2016, 2 pages.

(Continued)

*Primary Examiner* — Colleen M Chavchavadze
(74) *Attorney, Agent, or Firm* — TraskBritt

(57) ABSTRACT

A rope-climbing device has an upper assembly with planar side plates spaced apart by a roller, such that the side plates rotate relative to one another about a roller axis, a spine unit comprising planar links of common width each of half the plate spacing, the links pivoted at a central point, and a lower assembly comprising third and fourth side plates spaced apart by a clamp element such that the third and fourth side plates are enabled to rotate relative to one another about the clamp axis, and the clamp element is enabled to clamp a rope between the plates. The device may be opened by aligning pivot points, a rope inserted, and closed on the rope. Engaged on the rope, the device may be set to slide on the rope, or clamp to the rope by action of a user.

18 Claims, 5 Drawing Sheets

(56) References Cited

U.S. PATENT DOCUMENTS

| | | | |
|---|---|---|---|
| 4,450,603 | A | 5/1984 | Hirsch |
| 4,567,962 | A | 2/1986 | Kladitis |
| 5,145,036 | A | 9/1992 | Omalia |
| 5,544,723 | A | 8/1996 | Gettemy |
| 5,855,251 | A | 1/1999 | Deuer |
| 6,131,697 | A | 10/2000 | Bassett |
| 6,382,355 | B1 | 5/2002 | Kowalewski |
| 6,899,203 | B1 | 5/2005 | Golden |
| 7,533,871 | B1 | 5/2009 | Everett et al. |
| 8,167,086 | B1 | 5/2012 | Brendley et al. |
| 8,235,172 | B2 | 8/2012 | Thompson |
| 8,733,504 | B2 | 5/2014 | Mauthner |
| 8,950,550 | B2 | 2/2015 | Maurice et al. |
| 2005/0262669 | A1 | 12/2005 | Thompson |
| 2006/0081418 | A1 | 4/2006 | Thompson |
| 2007/0215411 | A1 | 9/2007 | Petzl et al. |
| 2008/0164096 | A1 | 7/2008 | Rogelja |
| 2009/0120720 | A1 | 5/2009 | Arms |
| 2009/0120738 | A1 | 5/2009 | Everett et al. |
| 2011/0186388 | A1 | 8/2011 | Sudale |
| 2011/0258815 | A1 | 10/2011 | Everette |
| 2011/0315480 | A1 | 12/2011 | Maurice et al. |
| 2012/0193166 | A1 | 8/2012 | Rogelja |
| 2012/0241700 | A1 | 9/2012 | Mauthner |
| 2013/0032433 | A1 | 2/2013 | Codega |
| 2013/0180800 | A1 | 7/2013 | Mauthner |
| 2014/0020988 | A1 | 1/2014 | Casebolt |
| 2014/0041960 | A1 | 2/2014 | Jones et al. |
| 2014/0174850 | A1 | 6/2014 | Paglioli |

OTHER PUBLICATIONS

International Written Opinion for International Application No. PCT/US2016/041758 dated Sep. 13, 2016, 6 pages.

ON-ROPE WORK POSITIONING DEVICE

CROSS-REFERENCE TO RELATED APPLICATION

This application is a continuation of U.S. patent application Ser. No. 14/805,366, filed Jul. 21, 2015, now U.S. Pat. No. 9,604,079, issued Mar. 28, 2017, the disclosure of which is hereby incorporated herein in its entirety by this reference.

TECHNICAL FIELD

The present invention pertains to a rope ascending/descending apparatus. The use of such apparatus relates to, but is not limited to: rope access, rock climbing, rescue work, and more specifically to work positioning as pertains to rope-assisted tree work.

BACKGROUND

In many jobs and activities it is highly desirable to provide a safe, secure, and easy to use way to both climb and descend a rope. This includes tree work, rock climbing, rescue work, and tower or building repair or maintenance. The nature of tree work in particular also requires that such systems/devices/apparatus allow for movement of a climber both vertically and horizontally within a tree. Traditional systems rely on friction hitches or prusik knots applied to a doubled length of rope, which runs over a limb or other anchor point in a dynamic 2:1 fashion. This is referred to as doubled dynamic rope technique (DdRT). More modern systems utilize a single length of rope affixed at one end to a limb or other anchor point in a static 1:1 fashion. This is referred to as single rope technique (SRT). The climber utilizes a device or apparatus that allows movement and positioning along the non-anchored leg of the rope. Due to the 1:1 nature of SRT, traditional friction hitches and prussic knots do not function satisfactorily. This necessitates the use of a mechanical element or device.

Since the introduction of SRT to the field of tree work, there is a need for a single device, which can not only be used to both ascend and descend in a safe manner, but also to do so in a simple, easy manner, using only one hand to tend the ascender/descender mechanism. In addition, there is a need to provide a device of this type that is durable, automatically clamps when weight is applied, easily and quickly attaches to, and detaches from the rope, is easily adjusted for a range of rope sizes and constructions, does not require the use of removable pins or parts, and is compact in size and comfortable in the hand. It is further desirable to be able to use a single device employing either SRT or DdRT without modification.

BRIEF SUMMARY

In one embodiment of the invention a rope-climbing device is provided, comprising:

an upper assembly comprising first and second parallel planar side plates each having a common shape with a first free end and a second pivotal end, the first and second side plates spaced apart a first dimension by a roller at a point between the first and second ends by a roller axis through both first and second side plates, such that the side plates are enabled to rotate relative to one another about the roller axis, and the roller is enabled to rotate on the roller axis, the first side plate having a first fixed pin extending beyond the first dimension at a point between the free end and the roller axis, and the second side plate has a slot extending from one edge a distance into the second side plate, such that, with the side plates in rotated position with first free ends and pivot ends matching, the pin is fully engaged in the slot, a spine unit comprising first and second elongated planar links of common length and shape, and a common width each of half the plate spacing, the links pivoted to one another at a central point, with one end of the first link joined pivotally to the pivot end of the first side plate of the upper assembly, and one end of the second link joined pivotally to the pivot end of the second side plate of the upper assembly; and a lower assembly comprising third and fourth parallel planar side plates each having a common shape with a first free end and a second pivotal end, the third and fourth side plates spaced apart at the first dimension by a clamp element at a point between the first and second ends by a clamp axis through both third and fourth side plates, such that the third and fourth side plates are enabled to rotate relative to one another about the clamp axis, and the clamp element is enabled to rotate on the clamp axis, the clamp element having an operating end configured to couple to a user's body harness, and a clamp end, the third side plate having a second fixed pin extending beyond the spacing of the third and fourth side plates at a point between the free end and the clamp axis, and the third side plate having a slot extending from one edge a distance into the second side plate, such that, with the side plates in rotated position with free ends and pivotal ends matching, the pin is fully engaged in the slot. The pivot points of the device, aligned in just one specific pattern, allow the first and second side plates of the upper assembly, the links of the spine assembly, and the third and fourth side plates of the lower assembly to rotate in concert, opening the device to allow a rope to be engaged between the first fixed pin and the roller of the upper assembly, and between the clamp element and the second fixed pin of the lower assembly, and wherein, with the rope engaged, the elements of the device are enabled to rotate in concert to close the device around the rope, and a user is enabled to rotate the elements with the device closed to slide freely on the rope or to clamp to the rope with weight applied to the operating end of the clamp element.

In one embodiment of the invention, the operating end of the clamp element comprises a ring of a size to engage a carabineer. Also in one embodiment, the first fixed pin comprises a first body eccentric to the pin axis, such that the first eccentric body may be rotated and fixed in different positions to adjust a distance between the roller and the eccentric body of the pin, thus accommodating ropes of different diameter. Also in one embodiment, the body and the fixed pin comprise a splined extension configured to engage a splined opening in the first side plate, such that the eccentric body may be inserted at different points and fastened to strongly resist rotation of the eccentric body in use. In one embodiment, the second fixed pin comprises a second body eccentric to the pin axis, such that the body may be rotated and fixed in different positions to adjust a distance between the clamp element and the eccentric body of the pin, thus accommodating ropes of different diameter. And in one embodiment, the device further comprises a third eccentric body of a diameter significantly larger than that of the second eccentric body, joined adjustably to the third side plate, engaging the second eccentric body in a manner that rotation of the second eccentric body adjusts the position of the third eccentric body relative to the clamp end of the clamp element, providing additional compensation for accommodating ropes of different diameters.

DETAILED DESCRIPTION

Figure 1:
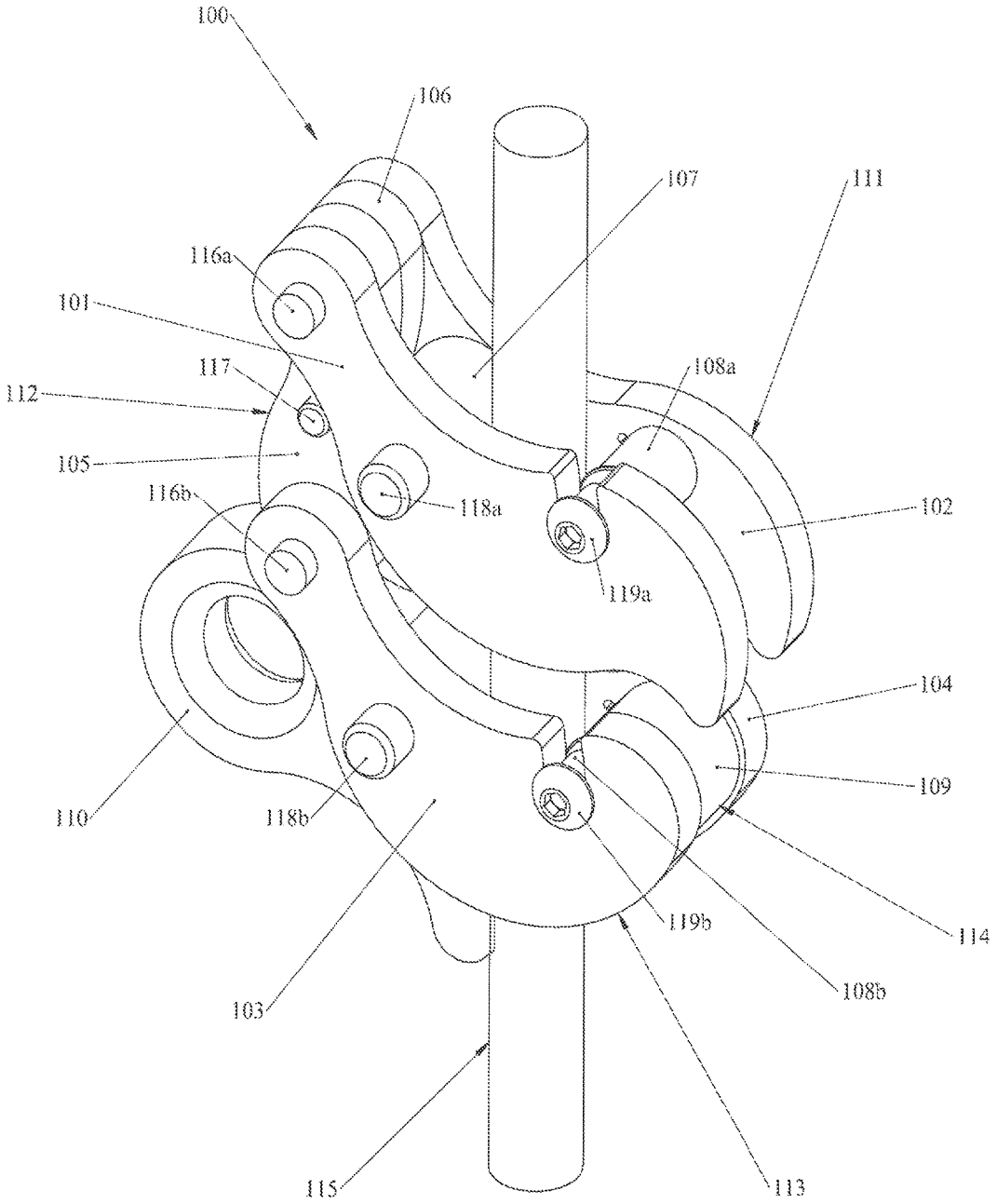
FIG. 1 is an isometric view of an on-rope work positioning device according to one embodiment of the present invention, shown in neutral working position installed on rope.

FIG. 1 illustrates an on-rope work positioning device 100 for ascending and descending on a rope, in neutral or collapsed position on a rope 115. Device 100 comprises an upper assembly 111, a spine assembly 112, a lower assembly 113, and a pin/bollard assembly 114.

Figure 2:
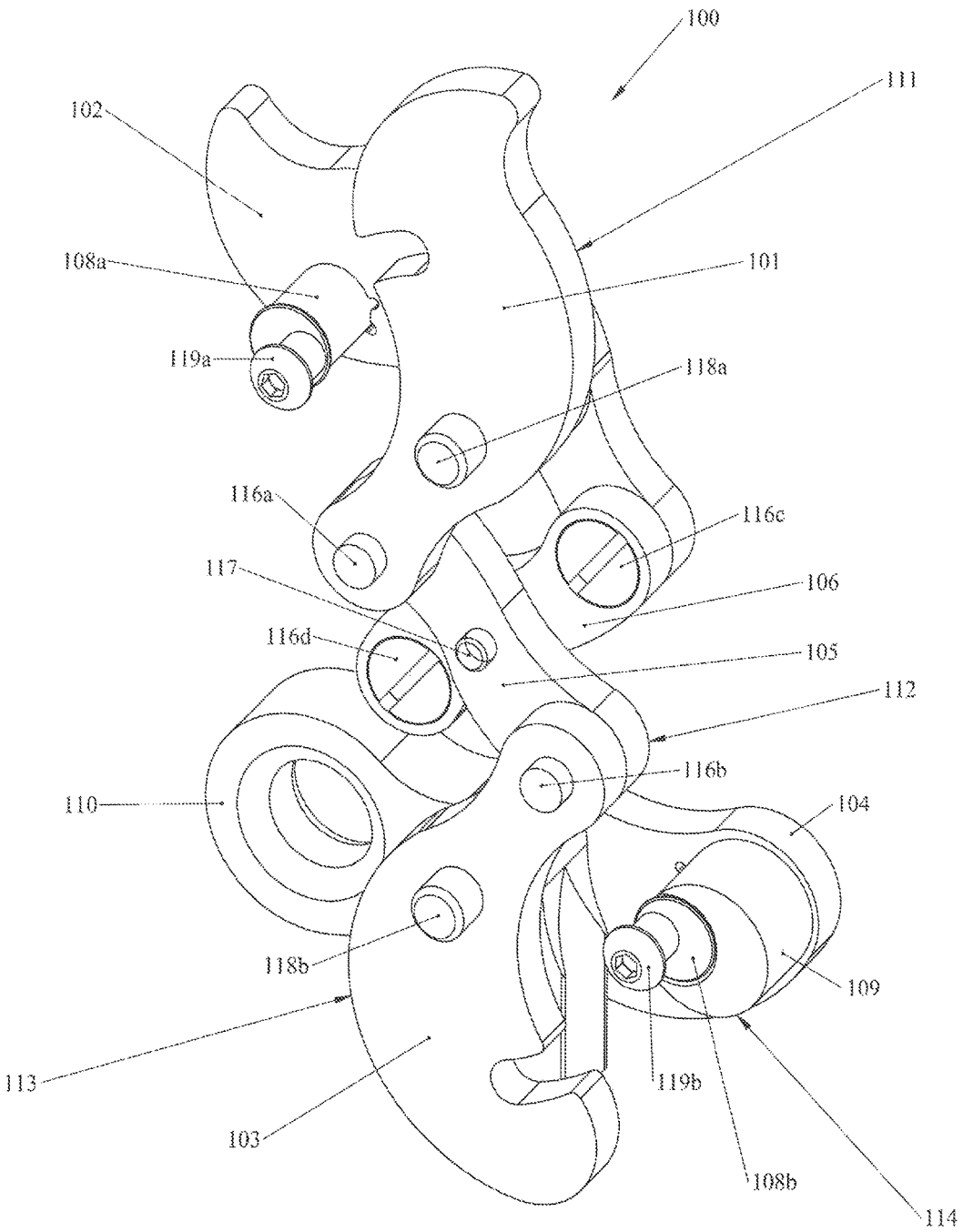
FIG. 2 is an isometric view of the positioning device of FIG. 1 shown in open position for installation of rope.

Upper assembly 111 comprises two generally parallel side plates 101 and 102. These side plates are elongate in shape, generally flat in cross section, are constructed of a rigid material appropriate for high wear and stress applications and comprise each a first, second, and third aperture arranged sequentially along the length, patterned such that the apertures of side plate 101 and 102 match. Both side plates 101 and 102 comprise a pivot end and a control end. The distal aperture of the control end of side plate 101 is formed as a slot sized to mate an end portion of eccentric pin 108*a*, which is bolt 119*a*, and is formed such that bolt 119*a* may pass out of the slot by means of rotation of either side plate 101 or 102 relative to the other side plate. Bolt 119*a* additionally constrains eccentric pin 108*a* laterally within the slot when in closed position, spacing the side plates 101 and 102. The distal aperture of the control end of side plate 102 is formed as (but not limited to) a round hole in some embodiments, and as a lobed star-shaped hole in some other embodiments, patterned to mate a matching pattern in an extended portion of eccentric pin 108*a*, (see FIG. 5). Roller element 107 is affixed between side plates 101 and 102 by bolt 118*a* through the center aperture of side plates 101 and 102, providing a pivot axis for roller 107, such that a rope 115 may pass within the aperture formed by the side plates 101 and 102, the roller 107 and eccentric pin 108*a*. The pivot end aperture of side plate 102 is joined pivotally to the upper aperture of link 106 by bolt 116*c* (FIG. 2). The pivot end of side plate 101 is similarly joined pivotally to the upper aperture of link 105 by bolt 116*a* (see FIG. 2).

Lower assembly 113 comprises two generally parallel side plates 103 and 104. These side plates are elongate in shape, generally flat in cross section, and are constructed of a rigid material appropriate for high wear and stress applications, just as are the side plates 101 and 102 of the upper assembly 111. Lower side plate 103 comprises a first, second, and third aperture arranged sequentially along the length. Lower side plate 104 comprises a first, second, third and fourth aperture arranged sequentially along the length (see FIG. 5) patterned such that the first, second, and third apertures of side plate 103 and 104 align. Both side plates 103 and 104 comprise a pivot end and a pin/bollard end. The distal (third) aperture at the pin/bollard end of side plate 103 is formed as a slot sized to mate the end portion of eccentric pin 108*b*, which is bolt 119*b*, and is formed such that bolt 119*b* may pass out of the slot by means of relative rotation between side plates 103 and 104. Bolt 119*b* additionally constrains eccentric pin 108*b* laterally within the slot when in closed position. A fourth aperture of the pin/bollard end of side plate 104 is formed as (but not limited to) a slot which has a long axis generally parallel to the long axis of lower side plate 104 (see FIG. 5). The third aperture of the pin/bollard end of lower side plate 104 comprises, but is not limited to, a round hole in some embodiments, or a lobed star-shaped hole patterned to mate a matching pattern milled or cast in an end portion of eccentric pin 108*b*, (see FIG. 5). Cam/anchor element 110 is pivotally joined between side plates 103 and 104 by bolt 118*b* through the center aperture of side plates 103 and 104, such that it may rotate freely about the major axis of bolt 118*b*, and such that a rope 115 passing through the upper assembly 111 may then pass within the aperture formed by side plates 103 and 104, the cam/anchor 110 and eccentric pin 108*b* without interference.

Cam/anchor 110 comprises a first and second aperture and a concave cam/friction face. The first aperture of cam/anchor 110 is sized such that a standard climbing carabineer may easily pass through the first aperture for the purpose of attaching a climber to the device 100. The second aperture of cam/anchor 110 mates pivotally to the second aperture of lower side plates 103 and 104 by means of bolt 118*b* and functions as a pivot fulcrum for the cam action of cam/anchor 110.

Figure 4:
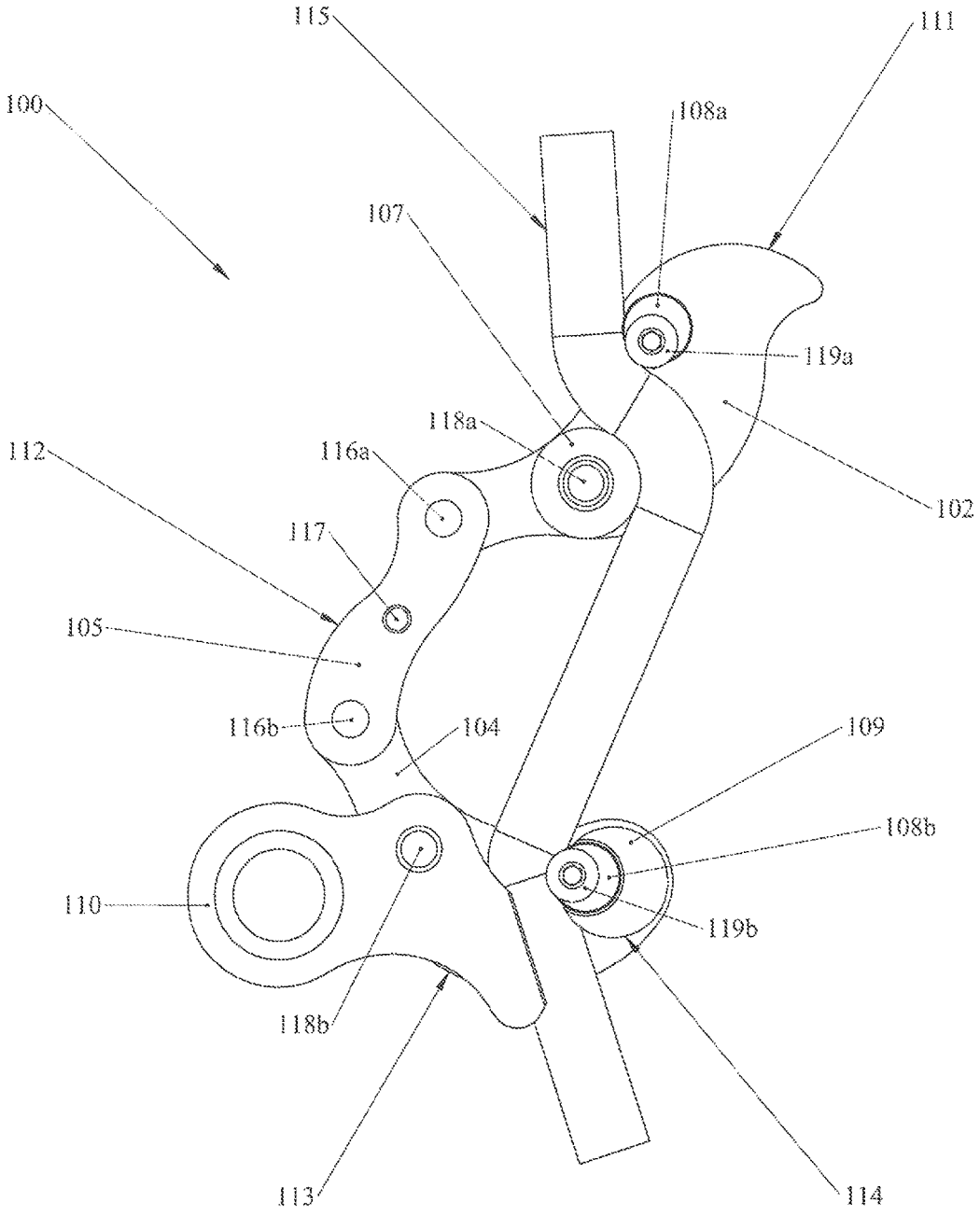
FIG. 4 is a side view of the positioning device of FIG. 1 shown in weighted position on rope (with upper and lower side plates not shown for clarity).
Figure 5:
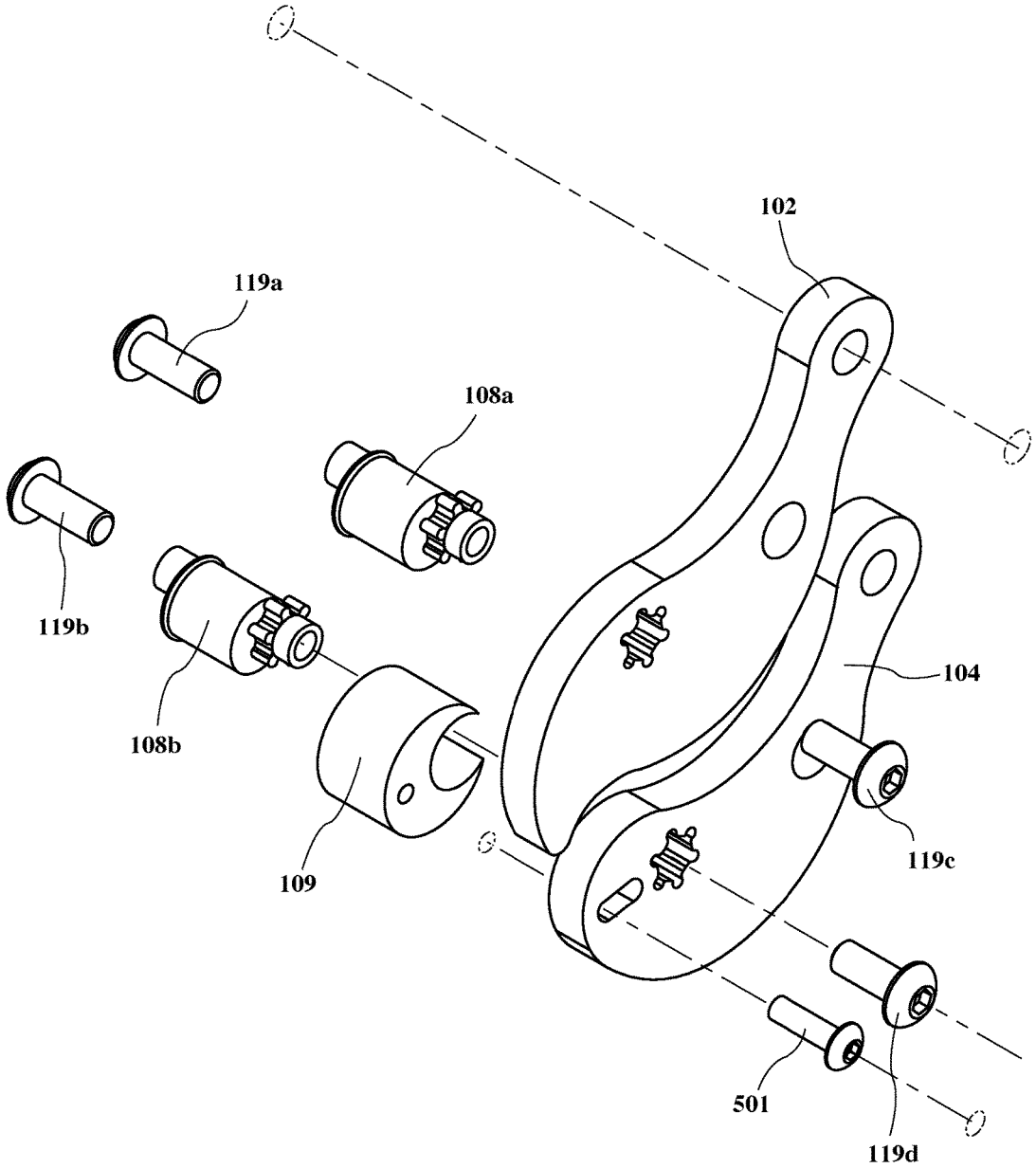
FIG. 5 is an exploded view of the eccentric pin and bollard assembly of the positioning device of FIG. 1.

Pin/bollard assembly 114 serves as an adjustable counter face upon which cam/anchor 110 compresses rope 115 (see FIG. 4) and comprises eccentric pin 108*b*, bollard 109, and bolts 119*b*, 119*d* and 501 (see FIG. 5). Eccentric pins 108*a* and 108*b* are identical and are constructed of a hard-wearing material such as steel and have a central portion with a width that matches that of the space between upper side plates 101 and 102 and lower side plates 103 and 104. At each end of the central portion there are extensions, both of which are centered about a common long axis, which is in turn parallel to and offset from the long axis of the central portion of the pin. Thus, when eccentric pins 108*a* and 108*b* are rotated about the long axis (rotational axis) of the smaller end extensions, the central portion rotates about the long axis in an eccentric fashion. Eccentric pins 108*a* and 108*b* are drilled and tapped through the rotational axis to receive bolts 119*a*-119*c*. Further, one end of each of eccentric pins 108*a* and 108*b* may be milled and/or shaped to a pattern matching that cut/milled into the third aperture of upper side plate 102 and lower side plate 104, thus providing a mechanism for indexing the position of rotation of the eccentric pin (see FIG. 5). In this manner, overall size of the rope aperture may be adjusted to accommodate various rope sizes and constructions.

Bollard 109 is constructed of a wear-resistant and lightweight material such as aluminum and comprises a circular barrel of the same width as the central barrel of eccentric pin 108*a* and 108*b*. Bollard 109 comprises a first and second aperture. The first aperture of bollard 109 is offset from center and parallel to the centerline such that the first aperture overlaps an edge of the barrel forming thereby a semicircular cutout (see FIGS. 2-5). The diameter of the semicircular cutout is the same as the diameter of the central portion of eccentric pin 108*b*. The second aperture comprises a tapped hole offset from and parallel to the center axis of bollard 109, and mates to the slot (fourth aperture) of lower side plate 104 by means of bolt 501 such that bolt 501 may move freely within the slot and bolt 501 further constrains an outer face of bollard 109 to be flush with an inner face of lower side plate 104 (see FIG. 5). The central portion of eccentric pin 108*b* fits within the first aperture of bollard 109 and rotates freely therein. As eccentric pin 108*b* is rotated to different positions, the eccentric position of the center barrel consequently moves bollard 109 in a reciprocal fashion constrained by bolt 501 within the slot (fourth aperture) in lower side plate 104 (see FIG. 5).

Bolt 119*d* is loosened to make such adjustment, and tightened again to hold bollard 109 in a new position.

Upper assembly 111 and lower assembly 113 are joined by means of spine assembly 112. Spine assembly 112 comprises link 105 and link 106, which are mirror images of one another, each having an upper and a lower end. Both links 105 and 106 are elongate in shape, generally flat in cross section, are constructed of a rigid material appropriate for high wear and stress applications, and comprise each a first, second, and third aperture arranged sequentially along the length. Both links 105 and 106 are affixed to one another pivotally by bolt 117 through their centermost (second) apertures in such a way that they may freely rotate about the major axis of bolt 117. The uppermost (first) aperture of links 105 and 106 are affixed to the pivot ends (first) apertures of upper side plates 101 and 102 respectively by bolts 116*a* and 116*c* (see FIG. 2). Bolts 116*a*-116*d* are identical and comprise a flat head countersunk into link 105 such that link 105 may lay flush to, and move freely past link 106 without interference from the bolt head, and such that upper side plate 101 may additionally rotate about the major axis of bolt 116*a*. Bolt 116*c* (see FIG. 2), link 106, and upper side plate 102 mirror the arrangement of bolt 116*a*, link 105 and upper side plate 101. The lower (third) aperture of link 105 and 106 mate with the first aperture of the pivot end of lower side plates 103 and 104 respectively in the same fashion as the upper (first) aperture of link 105 and 106 mate the pivot end (first) apertures of upper side plates 101 and 102.

As shown in neutral position in FIG. 1, device 100 moves freely along the length of rope 115 until the climber's weight is applied to the cam/anchor element 110, which moves the friction face of element 110 to compress the rope between the friction face and bollard 109, at which time the device 100 becomes configured in the locked position, as seen in FIG. 4.

FIG. 4 shows the device 100 in locked or stationary position with upper side plate 101 and lower side plate 103 removed for clarity. In this position, the device 100 holds the climber's weight and remains stationary on the rope 115 until such time as the device is unlocked by application of downward force upon upper assembly 111, to return the device 100 to the freely-sliding position shown in FIG. 1. When a climber's weight is applied, the force is transmitted from the cam/anchor 110 through the lower side plates 103 and 104, through links 105 and 106, to upper side plates 101 and 102 where friction between rope 115 and eccentric pin 108*a* cause side plates 101 and 102 to rotate roughly about the major axis of bolt 118*a*. This in turn causes the rope 115 to bend in a roughly "S" shaped curve about roller 107 and eccentric pin 108*a* thus increasing the friction generated at eccentric pin 108*a* and imparting a dragging force on the upper assembly 111. This force is transmitted down the spine assembly 112 to the connected ends of the lower side plates 103 and 104, which causes side plates 103 and 104 to pivot about the major axis of bolt 118*b* forcing the pin/bollard assembly 114 downwards and pushing the rope 115 into the face of cam/anchor 110. It is the combination of friction forces acting in concert at the upper and lower assemblies, which allow the climber's position to be held on the rope.

FIG. 5 shows an exploded view of pin/bollard assembly 114 and the mating of eccentric pin 108*a* to upper side plate 102 to illustrate an indexing function of these elements. The pattern manufactured into the end portion of eccentric pin 108*a* mates to the pattern manufactured in the third aperture of the upper side plate 102 for the purpose of indexing the rotational position of eccentric pin 108*a*. By withdrawing bolt 119*c* from eccentric pin 108*a*, eccentric pin 108*a* can be pulled out of its mating aperture and rotated to a new position. It is then reinserted and bolt 119*c* is tightened to hold eccentric pin 108*a* in place during use. Eccentric pin 108*b* mates with the third aperture of lower side plate 104 in the same fashion as above with the addition of bollard 109. Bollard 109 comprises a first and a second aperture. The first aperture of bollard 109 is offset from center and parallel to the centerline such that the first aperture overlaps the edge of the barrel forming thereby a semicircular cutout, the diameter of which is the same as the diameter of the central barrel of eccentric pin 108*b*. The second aperture comprises a tapped hole offset from and parallel to the center axis of bollard 109 and mates to the slot (fourth aperture) of lower side plate 104 by means of bolt 501 such that bolt 501 may move freely within the slot and bolt 501 further constrains the outer face of bollard 109 to be flush with the inner face of lower side plate 104. The central barrel of eccentric pin 108*b* fits within the first aperture of bollard 109 and rotates freely therein. As eccentric pin 108*b* is rotated to different positions, the eccentric position of the center barrel consequently moves bollard 109 in a reciprocal fashion constrained by bolt 501 within the slot (fourth aperture) in lower side plate 104.

FIG. 2 shows the device 100 in open position preparatory to engaging the device 100 to or disengaging the device from a rope. To open the device 100 from neutral position, the upper assembly 111, spine assembly 112, and lower assembly 113 must be aligned in such a way that bolts 118*a*, 116*a*, 117, 116*b* and 118*b* align in a straight line one to the other. Upper side plates 101 and 102 may then rotate in opposing directions about the major axis of bolt 118*a*, links 105 and 106 may rotate in opposing directions about the major axis of bolt 117, and lower side plates 103 and 104 may rotate in opposing directions about the major axis of bolt 118*b*. This results in a scissors-like action, which moves upper side plate 101 and lower side plate 103 away from eccentric pins 108*a* and 108*b*, respectively, and allows the rope to be inserted between the roller 107 and the eccentric pin 108*a* of the upper assembly 111 and the cam/anchor 110 and pin/bollard assembly 114 of the lower assembly 113. If any of the five pivot points is not in the straight line with the other four, then the device cannot open.

Figure 3:
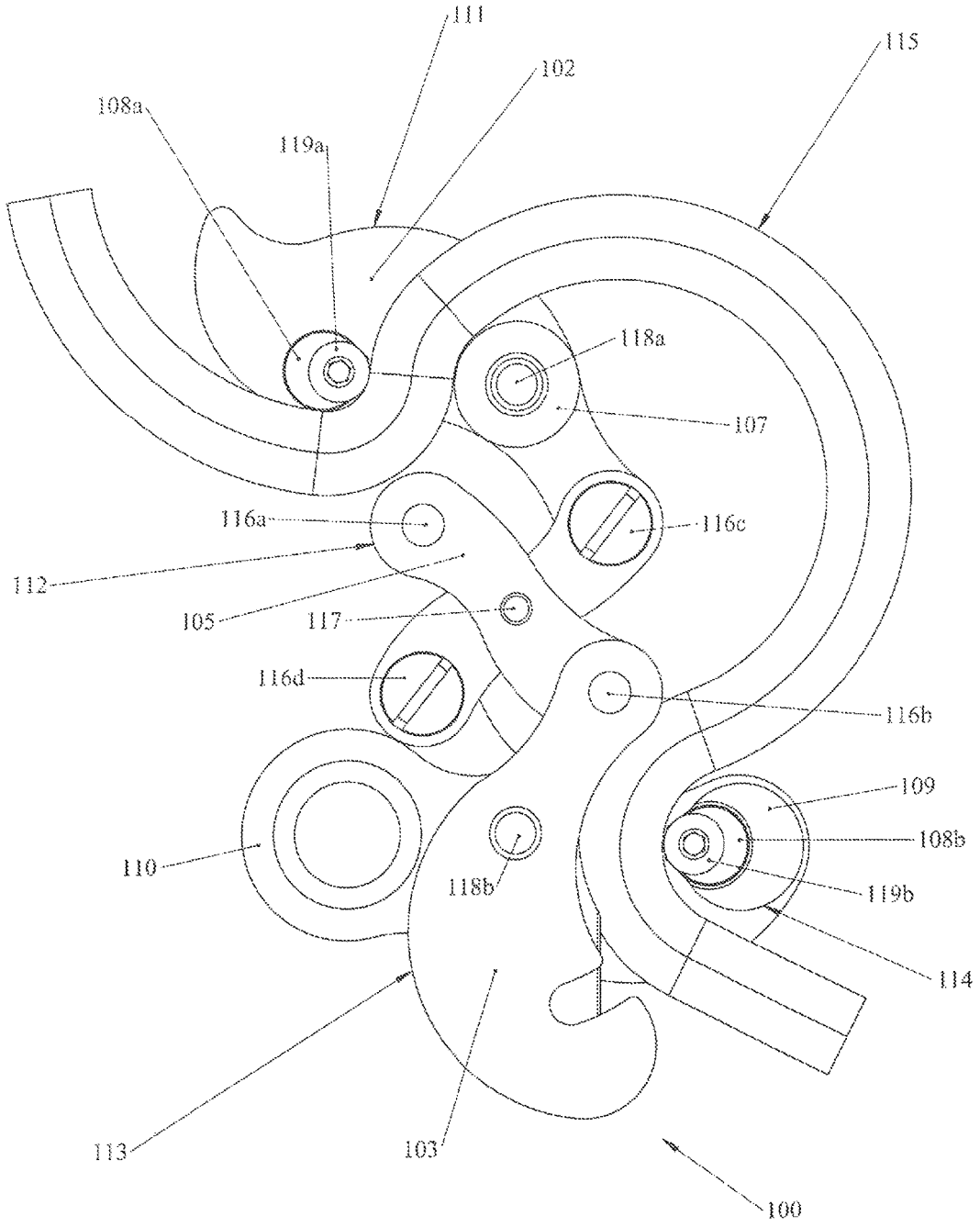
FIG. 3 is a side view of the positioning device of FIG. 1 shown in open position with rope installed preparatory for use.

FIG. 3 shows the device 100 in the open position with the rope path 115 illustrated, upper side plate 101 removed for clarity. The rope 115 is passed between eccentric pin 108*a* and roller 107 as shown, then down and between eccentric pin 108*b* and the concave friction face of cam/anchor element 110. The device 100 may then be closed, and weight may be applied to cam/anchor element 110, which will cause the device to seize the rope 115 and bear the weight.

The skilled person will understand that the descriptions made above are exemplary, and that there is a considerable range of variability in dimensions, material, fasteners, pivots and the like that may be made within the scope of the invention. Consequently, the scope of the invention is limited only by the claims that follow.

What is claimed is:

1. A rope-climbing device, comprising:

an upper assembly comprising a first side plate and a second side plate, each of the first and second side plates having a first free end and a second pivotal end, the first and second side plates spaced apart by a roller at a point between the first free ends and the second pivotal ends, such that the first and second side plates are rotatable relative to one another about a roller axis of the roller, the roller being rotatable about the roller axis, the first side plate having a first fixed pin extending laterally beyond the second side plate at a location between the first free end of the first side plate and the roller axis, the second side plate having a first slot extending from an edge of the second side plate into the second side plate, such that, with the first and second side plates in relative position such that the first free ends of the first and second side plates are aligned and such that the second pivotal ends of the first and second side plates are aligned, the first fixed pin is engaged in the first slot;

a lower assembly comprising a third side plate and a fourth side plate, each of the third and fourth side plates having a first free end and a second pivotal end, the lower assembly further comprising a clamp element disposed between the first free ends and the second pivotal ends of the third and fourth side plates, and a bolt coupling the clamp element to the third and fourth side plates, the third and fourth side plates being rotatable relative to one another about an axis of the bolt, the clamp element being rotatable about the axis of the bolt, the clamp element having an operating end and a clamp end, the third side plate having a second fixed pin extending laterally therefrom beyond the fourth side plate at a location between the first free end of the third side plate and the axis of the bolt, the fourth side plate having a second slot extending from an edge of the fourth side plate into the fourth side plate, such that, with the third and fourth side plates in relative position such that the first free ends of the third and fourth side plates are aligned and such that the second pivotal ends of the third and fourth side plates are aligned, the second fixed pin is engaged in the second slot; and a spine unit comprising a first elongated link and a second elongated link, the first elongated link and the second elongated link being pivotable relative to one another at a central location, one end of the first elongated link joined pivotally to the second pivot end of the first side plate of the upper assembly and another end of the first elongated link joined pivotally to the second pivot end of the third side plate of the lower assembly, one end of the second elongated link joined pivotally to the second pivot end of the second side plate of the upper assembly and other end of the second elongated link joined pivotally to the second pivot end of the fourth side plate of the lower assembly.

2. The rope-climbing device of claim 1, wherein the first and second side plates of the upper assembly, the first and second elongated links of the spine assembly, and the third and fourth side plates of the lower assembly may be rotated to open the device so as to allow a rope to be engaged between the first fixed pin and the roller of the upper assembly, and between the clamp element and the second fixed pin of the lower assembly.

3. The rope-climbing device of claim 1, wherein the rope-climbing device can move freely along the rope when the weight of a user is not applied to the operating end of the clamp element.

4. The rope-climbing device of claim 1, wherein the rope-climbing device is configured to remain stationary on the rope when the weight of the user is applied to the operating end of the clamp element.

5. The rope-climbing device of claim 1, wherein the operating end of the clamp element comprises a ring configured to engage a carabiner.

6. The rope-climbing device of claim 1, wherein the first fixed pin comprises a first eccentric body that is eccentric to an axis of the first fixed pin, such that the first eccentric body may be rotated and fixed in different positions about the axis of the first fixed pin to adjust a distance between the roller and the first eccentric body of the first fixed pin, thus accommodating ropes of different diameter.

7. The rope-climbing device of claim 6, wherein the first fixed pin comprises a splined extension configured to engage a splined opening in the first side plate, such that the first eccentric body may be inserted at different rotational orientations and fastened to resist rotation of the eccentric body relative to the first side plate.

8. The rope-climbing device of claim 1, wherein the second fixed pin comprises a second eccentric body that is eccentric to an axis of the second fixed pin, such that the second eccentric body may be rotated and fixed in different positions about the axis of the second fixed pin to adjust a distance between the clamp element and the second eccentric body of the second fixed pin, thus accommodating ropes of different diameter.

9. The rope-climbing device of claim 1, further comprising a third eccentric body of a diameter significantly larger than that of the second eccentric body, the third eccentric body joined adjustably to the third side plate, the third eccentric body engaging the second eccentric body in a manner such that rotation of the second eccentric body adjusts a position of the third eccentric body relative to the clamp end of the clamp element, providing additional compensation for accommodating ropes of different diameters.

10. A rope-climbing device, comprising:

an upper assembly comprising a first set of parallel plates pivotally coupled to one another by a first pin member, and a roller mounted on the first pin and configured to rotate about a central axis of the first pin member, one plate of the first set of parallel plates having a first fixed pin extending laterally therefrom toward the other plate of the first set of parallel plates, the other plate having a first slot therein located and configured such that the first fixed pin may be received within the first slot;

a lower assembly comprising a second set of parallel plates pivotally coupled to one another by a second pin member, and a clamp element disposed on the second pin member between the plates of the second set of parallel plates, the clamp element being rotatable about the axis of the second pin member, the clamp element having an operating end and a clamp end, one plate of the second set of parallel plates having a second fixed pin extending laterally therefrom toward the other plate of the second set of parallel plates, the other plate having a second slot therein located and configured such that the second fixed pin may be received within the second slot; and a spine unit comprising a first link and a second link, the first link and the second link being pivotable relative to one another, a first end of the first link joined pivotally to an end of one plate of the first set of parallel plates, a second end of the first link joined pivotally to an end of one plate of the second set of parallel plates, a first end of the second link joined pivotally to a first end of another plate of the first set of parallel plates, and a second end of the second link joined pivotally to a first end of another plate of the second set of parallel plates.

11. The rope-climbing device of claim 10, wherein the parallel plates of the upper assembly, the first and second links of the spine assembly, and the parallel plates of the lower assembly may be rotated to open the rope-climbing device so as to allow a rope to be engaged between the first fixed pin and the roller of the upper assembly, and between the clamp element and the second fixed pin of the lower assembly.

12. The rope-climbing device of claim 10, wherein the rope-climbing device can move freely along the rope when the weight of a user is not applied to the operating end of the clamp element.

13. The rope-climbing device of claim 10, wherein the rope-climbing device is configured to remain stationary on the rope when the weight of the user is applied to the operating end of the clamp element.

14. The rope-climbing device of claim 10, wherein the operating end of the clamp element comprises a ring configured to engage a carabiner.

15. The rope-climbing device of claim 10, wherein the first fixed pin comprises a first eccentric body that is eccentric to an axis of the first fixed pin, such that the first eccentric body may be rotated and fixed in different positions about the axis of the first fixed pin to adjust a distance between the roller and the first eccentric body of the first fixed pin, thus accommodating ropes of different diameter.

16. The rope-climbing device of claim 15, wherein the first fixed pin comprises a splined extension configured to engage a splined opening in the one plate of the first set of parallel plates, such that the first eccentric body may be inserted at different rotational orientations and fastened to resist rotation of the eccentric body relative to the one plate of the first set of parallel plates.

17. The rope-climbing device of claim 10, wherein the second fixed pin comprises a second eccentric body that is eccentric to an axis of the second fixed pin, such that the second eccentric body may be rotated and fixed in different positions about the axis of the second fixed pin to adjust a distance between the clamp element and the second eccentric body of the second fixed pin, thus accommodating ropes of different diameter.

18. The rope-climbing device of claim 10, further comprising a third eccentric body of a diameter significantly larger than that of the second eccentric body, the third eccentric body joined adjustably to the one plate of the second set of parallel plates, the third eccentric body engaging the second eccentric body in a manner such that rotation of the second eccentric body adjusts a position of the third eccentric body relative to the clamp end of the clamp element, providing additional compensation for accommodating ropes of different diameters.

* * * * *